US011365612B2

(12) United States Patent
Ellithorp

(10) Patent No.: US 11,365,612 B2
(45) Date of Patent: Jun. 21, 2022

(54) METHOD TO IMPROVE HYDRODYNAMICS AND EFFICIENT USE OF AN OIL AND/OR GAS WELL'S ENERGY TO LIFT FLUIDS THROUGH SUPERFICIAL GAS VELOCITY MAINTENANCE AND APPLICATION OF LOAD REGULATING DEVICE(S)

(71) Applicant: Brian Ellithorp, Edmond, OK (US)

(72) Inventor: Brian Ellithorp, Edmond, OK (US)

( * ) Notice: Subject to any disclaimer, the term of this patent is extended or adjusted under 35 U.S.C. 154(b) by 38 days.

(21) Appl. No.: 16/832,380

(22) Filed: Mar. 27, 2020

(65) Prior Publication Data

US 2020/0308943 A1 Oct. 1, 2020

Related U.S. Application Data

(60) Provisional application No. 62/826,358, filed on Mar. 29, 2019.

(51) Int. Cl.

| | |
|---|---|
| ***E21B 34/08*** | (2006.01) |
| ***E21B 43/12*** | (2006.01) |
| ***E21B 43/38*** | (2006.01) |
| ***E21B 33/12*** | (2006.01) |
| ***F04B 49/22*** | (2006.01) |
| ***F04B 47/00*** | (2006.01) |

(52) U.S. Cl.

CPC ..... *E21B 43/126* (2013.01); *E21B 33/12* (2013.01); *E21B 34/08* (2013.01); *E21B 43/38* (2013.01); *F04B 47/00* (2013.01); *F04B 49/225* (2013.01)

(58) Field of Classification Search

CPC ..... E21B 33/12; E21B 34/08; E21B 43/126; E21B 43/38; F04B 47/00; F04B 49/225

See application file for complete search history.

(56) References Cited

U.S. PATENT DOCUMENTS

| | | | | |
|---|---|---|---|---|
| 1,407,873 A * | 2/1922 | Carl | E21B 33/14 166/292 |
| 3,283,570 A * | 11/1966 | Jamesw | E21B 47/10 73/152.31 |
| 4,241,788 A * | 12/1980 | Brennan | E21B 43/38 166/105.5 |
| 5,220,962 A * | 6/1993 | Muller | E21B 43/00 166/105 |
| 9,790,779 B2 | 10/2017 | McCoy | |

* cited by examiner

*Primary Examiner* — Cathleen R Hutchins
*Assistant Examiner* — Ronald R Runyan
(74) *Attorney, Agent, or Firm* — Brannen Law Office, LLC

(57) ABSTRACT

A hydrocarbon wellbore production apparatus includes a tailpipe and a control valve connected with the tailpipe. The tailpipe has a fluid inlet receiving well fluids entering the casing from a formation, and a fluid outlet above the fluid inlet to deliver well liquid to a connected pump inlet. The control valve is operable to (i) open when a lower fluid pressure below the flow control valve exceeds an upper fluid pressure above the flow control valve to allow upward flow through the flow control valve, (ii) close when the upper fluid pressure exceeds the lower fluid pressure by an amount which does not exceed a prescribed pressure limit value to hold fluid in the apparatus above the flow control valve, and (iii) open when the upper fluid pressure exceeds the lower fluid pressure by an amount which exceeds the pressure limit value to release excess fluid back down the tailpipe.

25 Claims, 3 Drawing Sheets

METHOD TO IMPROVE HYDRODYNAMICS AND EFFICIENT USE OF AN OIL AND/OR GAS WELL'S ENERGY TO LIFT FLUIDS THROUGH SUPERFICIAL GAS VELOCITY MAINTENANCE AND APPLICATION OF LOAD REGULATING DEVICE(S)

This application claims the benefit under 35 U.S.C. 119(e) of U.S. provisional application Ser. No. 62/826,358, filed Mar. 29, 2019.

FIELD OF THE INVENTION

The purpose of this patent is to illustrate the inherent benefits of maintaining, and/or exceeding sporadically, adequate superficial gas velocity (VSg) to meet conditions in which an oil and/or gas well, most likely possessing a horizontal lateral and/or heavily deviated bottom section, produces enough gas or hydrocarbons such that the VSg it high enough (i.e. with enough velocity in-situ) to lift fluids (typically water and/or oil) upward and ultimately vertically from the wellbore (likely from a lateral or bottom portion of a deviated section), that are produced from liquids and hydrocarbon yielding zones completed within the lateral or bottom deviated section. Those fluids are to be flowed through the proposed means of augmentation(s) upward through and above the curved or heavily deviated portion of the wellbore's construction (the more difficult-to-lift fluids portion of those wells) ultimately to a more vertical position for the fluids to be more completely and effectively produced in a more conventional fashion from such deviated wellbores by any and all forms of artificial lift including, but not limited to rod pump, electrical submersible pump, plunger lift, progressive cavity pump, jet pump, concentric jet pump, hydraulic reciprocating pump, gas lift, plunger lift assisted gas lift, gas lift assisted plunger lift, and foam lift.

BACKGROUND

Fluids and gases produced in multi-phase flow have highest tendencies to separate from one another "naturally" (i.e. gas floats high-side and fluids fall low-side) in the curve of a wellbore at and near to ~38-45 degrees inclination, or roughly the center of the curve. The effects reduce on either side of this primarily difficult zone whether above at inclinations progressively lessening (i.e. inclination from 37 through 20 degrees, or more vertical, and at progressively higher inclinations deeper than 45 degrees (i.e. between 46 and 65 degrees), or more horizontal. This tendency thus alters and substantially increases the required VGs to lift the fluids in the mixture through such inclinations being produced and to lift them effectively through said curve or high level of inclination. TNO/Shell equation further validates this by noting an approximate VSg "modification" necessary to be made at specific inclinations. They show the required VSg increases as inclination increases from a vertical position through the curve to a max modification adding ~35% to the calculated Turner critical velocities at 37 degrees inclination. They note as inclination is progressive less than 37 degrees, moving more into the vertical portion of the wellbore, the modification concurrently lessens until the VSg re-converges with the more simplified Turner method at 0.0 degrees or completely vertical. Similarly, their modification concurrently lessens below 37 degrees as the curve builds more completely and flattens out horizontally.

With these dynamic requirements being taken into consideration, and also being recognized within the oil and gas industry as being very close to correct and accurate (by those who are even aware of this phenomenon) for a very large percentage of well conditions typically seen, it is not surprising with the rapidly growing number of wells completed horizontally, or inclined, as they produce over time the production rates are declining and stability in their production characteristics and specifically hydrodynamic stability becomes worse in that time because the wellbores, and especially the curves and laterals, become liquid loaded. These instabilities are most often revered as "normal" byproducts of horizontal wells and not appropriately addressed even though they can wreak havoc on downhole pumping systems such as, but not limited to rod pumps, ESPs, PCPs, Gas Lift, and other reciprocating forms of artificial lift or more simply, "lift", as well as systems that aim to take advantage of the wells own energy (i.e. with the gas the wells produce themselves), and/or augment that energy with an introduction of gas through an external source (e.g. gas lift and high pressure discharge compressor units), or augmenting that energy with a form of mechanical and wellbore-traveling means such as a plunger lift system.

The main reason for this liquid loading to occur and worsen over time is, among other important items, due to the fact that most wellbores are completed with a larger size of casing with a large inner diameter (ID) profile that is more aligned with all the other elements and stages of constructing that well other than making it produce hydrocarbons in an optimal fashion. Requiring the ability to case today's common wellbores and horizontal laterals which span many thousands of feet (commonly 4000'-+12,000' horizontally) and complete the zone(s) of interest by means of hydraulic fracturing at very high rates of injection (e.g. ≥100 barrels per minute), most frequently requires casing of reasonably large size to accommodate the physical pushing of that pipe out to the desired setting depth as well as the hydraulics and resultant pressures witnessed during the completion or fracturing phase of those wells since such high pumping rates and such long distances traveled by the liquid slurry can result in excessive friction losses. On the latter and opposite end of a well's life, that same larger casing that was previously known to be beneficial now becomes a hinderance as it relates to liquid loading and a stable producing environment within.

Liquid loading is created in both the curved section as well as the vertical section when velocities fall below certain critical rate or VSg requirements in the wellbore. As previously noted, the curve requires more VSg to unload than the vertical and horizontal portions of a wellbore so it is thus understood the curve would be the first portion of the well to "load up" or "liquid load" with accumulated liquids, even if gas is still being produced through such a column, but at a rate below the unloading rate required. The result is an accumulated fluid load or "fluid plug" in the curve or deviated portion of the well which exacerbates gas build up from below and once a certain threshold is met the gas purges aggressively through the collected fluid section wherein a high instantaneous gas spot rate is generated and "slugging" is witnessed. Slugging is an unwanted condition and avoiding it is known to greatly help in producing wells better. This makes for difficult pumping conditions, and difficulty in gas separation if desired, during this slugging cycle which typically is rather short in duration. After the accumulated gas has relieved itself during the purge cycle, the rate at which gas is flowing can quickly fall below the VSg required to lift the fluids across the curve especially or deviated section since they require the highest VSg and thus the section begins to liquid load again and the cycle is repeated over and over. The intention of this patent is address the poor and unfavorable wellbore dynamics witnessed over time in essentially all wells that produce liquids (oil and/or water) and give them the opportunity to maintain a much more desirable "unloaded" state (either all of the time or at very least more of the time) to maximize drawdown on the producing interval(s), allow for a far more consistent production profile regarding gas and fluid production rates, and to minimize or in some cases eliminate slugging of fluids and gases previously witnessed in and/or anticipated for wellbores of typical sizes and related internal diameters-most commonly ~4.0" up to ~6.0" ID.

The required unloading rate or VSg is predominately and directly related to the internal flowing area or cross-section of the casing and, again as previously noted, the inclination of the deviated wellbore. It would make much sense then by reducing the flowing area or cross-section the fluids and gas mixture flows through one would have a much better opportunity to keep the curved or inclined portion of the wellbore unloaded. Through the application of this process in its simplest form, flowing the mixture through the ID of an isolated tailpipe (FIG. 1 and FIG. 2) to a lift mechanism set further uphole (likely in or near a vertical position) creates a conduit to flow through of smaller cross-section than the large casing ID it is placed within and a reduction in the gradient of the mixture flowing within said conduit is expected to be reduced. (Cite McCoy patent #9,970,779 B2). This reduction in gradient is anticipated to be directly conveyed onto the formation below the smaller ID tailpipe and, thus, by alleviating pressure off the producing interval (s) the well is anticipated to produce more volume of liquids and gas.

There is certain merit to this process and theory as it has been validated over the past few years to generally improve production volume output peak values in hundreds of wells with such an artificial lift augmenting system applied. It is also now known that the cyclical nature with which horizontal wells tend to produce gas and fluids is not only driven by liquid loading in the curve alone, it is also compounded by ever growing horizontal lateral lengths and the opportunities for sinusoidal trajectories that every well possesses. These sinusoidal humps and bumps in the laterals create troughs which accumulate fluids and the more severe they are the more fluid volume they will tend to accumulate. Further, these accumulations allow gas the build up behind themselves and ultimately that pressurized gas volume overcomes the restriction of the liquid holdup and purges from the lateral progressive toward and ultimately ending up at the heal or around the bottom of the curve in all wells.

This fairly unpredictable movement of liquids out of the lateral creates a very challenging condition as it relates to lifting those fluids fully and consistently from the base or trough of the curve. Further the daily gas volumes produced in these wells from one day to the next may be very similar, but as a result of the sinusoidal lateral trajectory and related slugging, the instantaneous gas spot rate at any given minute throughout the day is likely to swing widely over relatively short time spans and the VSg requirement is likely to not bet met and exceeded continuously, thus liquid loading takes place in those wells especially when flowing through larger casing ID's, but also in isolated tailpipe application as described above. There must be enough VSg maintained to lift all the accumulated fluids from the trough, across the curve (especially its most difficult portions to lift as previously noted), and to a proper take-away point whether utilizing some form of pump, plunger, or gas-lift assist in most cases, or in the simplest form, under its own power with produced gas only, regardless of the size of the conduit the mixture is flowing through.

Where the McCoy patent falls short and thus results in poor and unacceptable performance is in the lack of understanding at that time how important maintaining the wells own energy and VSg is and focusing a proper design along the entire tailpipe, both inside and out. This is especially notable in older and aging wells producing at generally lower gas rates that tend to fall more easily below the required VSg, but also in higher rate wells operating at higher bottom-hole pressures too, when addressing this exact thing; the fact that the VSg is not being achieved and strategically maintained enough of the time while on production to net the proposed benefit of such a system is the major flaw in such a rudimentary approach (also other benefits not proposed by the McCoy patent will be outlined herein).

The first item to address is the problem of a disconnect regarding velocity requirement or VSg in the curve versus the larger casing ID or even internal tailpipe flow much of the time due to the inconsistency with which gas flows out of the lateral. There is nothing that can be done to go back and straighten a well trajectory out after the well has been cased and completed, so the next best option is to exercise a thoughtful approach to achieving and maintaining an optimal VSg more or all of the time while producing without creating negative side-effects.

One such side-effect that is commonly witnessed in an isolated tailpipe application design is one that is generally prompted by relying on computer modeling programs such as a nodal analysis software which predicts VSg within all portions of the modeled wellbore. Unfortunately nodal program assume a steady-state condition is being held 100% of the time and as such one will likely be led to an ID profile that should meet the required VSg most or all of time at that given condition, but in reality due to the cyclical gas spot rate coming from these wells, if the ID is not small enough and resultant VSg is not maintained high enough, certain liquid loading will occur.

To further the problem, if a designer determines they can head that problem off by simply reducing the ID cross-section to a much smaller size to ensure the required velocity will be met and maintained, when the well gasses off at a high gas spot rate there is ample opportunity generated for unnecessary and unwanted backpressure which will indeed choke and reduce the production of the well, and sometimes results in scaling tendencies and paraffin/wax deposition which have ability to plug and foul such systems too. On the same lines, if too small of an ID is used in a well that produces a fair amount of fluids the opportunity to liquid load such a tailpipe with hundreds or even thousands of vertical feet of fluid when these fluids are delivered from the lateral and are up-taken into the tailpipe is far more likely due to the small liquid volume capacity per unit length there is in such a pipe due to it's very small cross-section. This type of loading will result in a substantially heavy weight hydrostatic column that would have to be lifted by the gas pressure below and can be very disruptive to the gas outflow from such wells as well as their ability to produce with stability, which is known to be beneficial for virtually all forms of artificial lift and flowing wells.

SUMMARY OF THE INVENTION

This patent proposes a series of techniques that work individually if feasible or in combination if necessary through which to take advantage of a wells' natural energy in refined and tested fashions that have been validated to function successfully in many actual producing wells.

One solution or part of a series of items to form a final cumulative solution to solve problems noted is to run a "Tapered-string" design for the tailpipe to be place within the curve of the casing that takes into adequate account the impact inclination will have on the required VSg and from there run a corresponding ID pipe to yield at least the required VSg for that portion of the wellbore. As the curves of wells typically range anywhere from 400-600' long on the shorter side, 600-1000' long as an average, and +1000' on the longer side, to create proper VSg from the hardest to lift portion without of the curve will only account for a portion of those tubing lengths, thus it is most fitting to run the "Taper-String" consisting of two or more sections of tailpipe with a larger or smaller ID to allow for the optimal VSg to be met at each point within the wellbores curve and without creating unnecessary or unwanted backpressure and other negative side-effect previously noted.

Tapering a tailpipe string allows a well to flow much more consistently in a wider range of rates and pressures as well a larger variety of conditions over time as bottom-hole conditions change. This is not only useful for higher and mid-rate wells, but also in lift systems or free-flowing wells that utilize "intermitting"/"intermittent" production or an on/off production pattern to allow the well to build pressure and flow off naturally. In this type of production cycle, very commonly used with a variety of plunger lifts designs, the timeframe where a well is flowing across the curve at a VSg high enough to lift fluids on its own is often very short and possibly unachievable all together. Application of a tapered string in a plunger lift well particularly would allow placement of the plunger lift equipment to be set in or near the vertical position within the wellbore to run in a more "conventional" or "traditional" way as opposed to running the plunger equipment through the curve and looking to plunger lift the fluids mechanically from or near the bottom of the curve where the pipe is landed and all the way to surface. The tapered string would open up the opportunity for the well to lift fluids with it's own energy and gas rate from the trough of the curve up to the seating nipple position where the plunger could cycle from with the right bottom hole assembly (FIG. 2 and FIG. 3). This would relegate plunger operations and travel path to the more vertical portion of the wellbore where it is far less likely to have said plunger get stuck downhole and be difficult or impossible to fish out, thus requiring the tubing string to be pulled if such an event occurred. Further, this more vertical bottom cycling position of the plunger in these cases will allow for a more complete lifting of the accumulated fluid slug or load for each cycle with less slippage or inefficiency occurring in those cycles as typically occurs with operation of said plunger though the curve or as done in a more standard operation with a deeper plunger bottom cycling position (e.g. set at ~45-60 degrees).

Another solution or part of a series of items to form a final cumulative solution to solve problems noted is to run a single valve or series of valves that are hydrostatic pressure-regulated (i.e. auto-dump valves) and placed at strategic position(s) along the tailpipe such that when the well produces enough gas spot rate such that the well's fluids are carried uphole and are not quite able to be lifted completely across the entire curve, which is again the most difficult portion of the wellbore to lift, those fluids will fall back downhole, but instead of falling completely back to the bottom of the curve or trough requiring them to make the completely journey again, they will stack on top of the nearest pressure-regulated valves below, thus conserving much of the well's expended energy for that particular gas purge cycle we know these horizontal wells to generate. The valves are to be set with a specific amount of hydrostatic load carrying capability, with effort put into matching that particular well's strength and pressure capabilities, and will only be capable of holding that predefined load or height of fluid above them while the rest of the accumulated fluid load that is in excess of the hydrostatic rating of that valve will be allowed to flush back down hole before the valve(s) check themself. Upon the next gas purge cycle wherein the VSg is in excess of the required pace to lift those accumulated fluids they will be lifted further up the wellbore by the well's own gas during that cycle to the next valve positioned above and ultimately pumped or flowed completely out of the wellbore.

A valve's optimal placement is very much tied to the geometry of the curve as well as the gas spot rate potential, thus a logic can be defined. As previously noted, knowing the most difficult portion of the curve to lift (e.g. ~30-50 degrees) and also likely knowing the wells current ability to meet or exceed the required VSg to lift fluids through such a curve via a rigorous and accurate nodal analysis model, it can be determined the likelihood or unlikeliness of a well to produce enough sustained gas rate in any gas purge cycle to completely lift the fluids across the curve. Almost all wells due to the shape of their laterals and their undulating trajectories will experience much difficulty in constantly maintaining the required VSg to lift fluids effectively, sometimes even with a tapered-string properly applied. The addition of the lowermost valve, most typically placed in a position such that the fluids accumulate on top of this bottom valve, will when loaded yield liquid straddling the hardest portion of the curve to lift (i.e. 30-50 degrees). The next high gas spot rate event during a gas purge cycle will have an advantage to lifting those fluids a shorter distance up to the next valve or even simply a more vertical position requiring a lesser VSg in that section of the wellbore. The uppermost valve (if utilized) is typically placed at or very near to a pump or plunger seat nipple assembly wherein a fluid slug may be delivered to its vertical or near vertical position and will catch that predefined load there at its position for the accumulated fluid to be pumped, lifted, for flowed away at the very next opportunity.

The compression rate or hydrostatic holding capability of each valve can be custom tailored to each wells' own properties and production behaviors. Weaker rate and pressure wells would not be best suited to be overburdened by too much liquid accumulation and a high level of hydrostatic pressure to buck from below each valve, thus one may likely desire to limit at least the bottom valves ability to hold too much fluid column since it could become difficult or impossible for said well to lift a bigger slug of fluids uphole due to an overall lower gas spot rate capability as well as a shorter duration of time in which the well would be capable of flowing at or above required VSg.

Conversely, if a well has high rate potential and presumed ability to easily stay at or above required VSg both in the curve and/or in the vertical position much of the time on production one may desire to increase some or substantially the hydrostatic holding capacity of either, both valves in a 2-valve system, or all valves if more than 2 are used.

Another solution or part of a series of items to form a final cumulative solution to solve problems noted is to run an annular isolation or sealing element on the bottom-end of a tubing string, whether tapered or not or utilizing valves or not when used in an artificial lift augmenting system utilizing a tailpipe assembly placed through the curve of a horizontal or highly deviated well in effort to improve flowing dynamics, lift efficiency, and lift potential through more effective maintenance and focused use of the well's own produced gas volume in a given day certainly, but especially during times of high gas spot rate surges.

When a well has an open-ended tailpipe assembly run through the curve and is produced up the ID, whether tapered or not, there is the ability for gas to collect behind the tailpipe and accumulate in the annular area below the isolating mechanism typically placed much further uphole in or around the vertical section (FIG. 2). This annulus can build up significant volume of gas and pressure as large fluid loads are delivered out of the lateral, often sporadically, to the trough of the curve and around the end of tubing placement. In order to lift the lift the accumulated fluid load uphole not only does the VSg for the curve need to be met or exceeded to lift the fluids with the well's own produced gas, this downhole configuration will also yield the need for a hydraulic equalization to be experienced between the fluid column being lifted inside the tailpipe and the gas accumulated in the annular space behind the same pipe. The heavier the fluid load is the more volume of gas produced from the lateral that will need to accumulate in the annuls to ultimately allow gas to pressure up and invade or flow through the collected fluid column in the tubing. As this column of fluid is carried uphole by the gas production and pumped or flowed uphole and out of the wellbore, the burden to lift such a column is relieved and thus the gas trapped below the isolation mechanism uphole is then progressively allowed to rapidly relieve itself by purging around the end of tubing and is produced up the ID of the tailpipe string. This process and bottom-hole set up results in very cyclical and erratic gas rates flowing through the tailpipe assembly which can cause problems agitating fluids and entraining gas in the solution which can be bad for some forms of lift which are most likely placed uphole and above such assembly. This is also potentially a negative situation for wells relying on a more regulated and steady gas production rate to make for longer and more sustained lift cycles where the VSg for the well is otherwise only maintained for a short period of time when the well gas spot rate surges then quickly and frequently drops below the required profile.

Running what we consider a tailpipe "toe-isolator" will allow the bottom of the tailpipe to be packed off and have the annulus pressure locked in place such that all produced gas and fluids will preferentially be produced up the ID of a tailpipe assembly at all times, no gas would then be capable of packing up in the annulus to create a high-pressure accumulation creating the opportunity to yield negative flow dynamics and build-and-purge events. The application of such a toe-isolator is most often run in conjunction with an uphole isolating mechanism as well that creates the fully blocked annular flowpath.

The result is a far more focused production path for all gas that is produced out of the lateral of a horizontal well, whether delivered with fair consistency or in large slugs. The more direct flowpath for the gas helps ensure all gas produced is working within the right position of the wellbore (i.e. inside the ID of the tailpipe section) at all times to lift fluids effectively through the curve of that wellbore and no energy is wasted in the effort to lift fluids as gases accumulate in an open annulus as before.

Each of the items listed above can be utilized individually, but most often all are run together, in effort to more effectively use any and all energy a well gives up through way of gas production, regardless of how extreme or benign the wells production behavior is currently without these items applied. This clearly defined and purposeful application of the tools and techniques for the purpose of greatly improving hydrodynamic performance and superficial gas velocity maintenance is something that has never seen such focus with such defined instruction to date. Unlocking production potential of horizontal wells is technically a very new process and early in its challenging development. It is not a surprise even a person skilled in the art would look at these items individually, or cumulatively, and presume that their application in wells with lower average daily production volumes like those seen in many aging wells would not lend itself to the idea that these tools could indeed get a well unloaded and/or keep them from becoming liquid loaded again; interestingly, though, the results simply do not line up with many experts' and very experienced engineers' "perceived reality" nor the nodal analysis' suggestions that a negative output potential should be the result in many cases.

These items applied in numerous test wells clearly proves to have allowed typical very low gas rate producing wells to overcome a heavily liquid-loaded wellbore and lateral to ultimately achieve results well beyond the standard inflow/outflow calculations used across the industry. These items working in unison is allowing more fluid to be lifted off of the horizontal legs of these wells with less total average gas volume than ever before, yielding a more fully deliquefied state to be reached and maintained. This in turn yields higher gas production rates and thus the wells ability to lift fluids aligns more with and most frequently then exceeds the required minimum VSg at all times of production; it's a progressive series of positive conditions being met that is all set off by this series of tools, designed correctly, and applied in the proper fashion.

According to one aspect of the invention there is provided an apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and coupled to the pump inlet to deliver well liquids thereto;

at least one flow control valve connected in series with the tailpipe being operable between open and closed states and having a pressure limit value associated therewith, the flow control valve being operable to (i) open when a lower fluid pressure below the flow control valve exceeds an upper fluid pressure above the flow control valve to allow upward flow through the flow control valve, (ii) close when the upper fluid pressure exceeds the lower fluid pressure by an amount which does not exceed the pressure limit value to hold fluid in the apparatus above the flow control valve, and (iii) open when the upper fluid pressure exceeds the lower fluid pressure by an amount which exceeds the pressure limit value to release excess fluid back down the tailpipe. Preferably two flow control valves are provided at longitudinally spaced locations relative to one another, including one flow control valve at a location spaced above a bottom end of the tailpipe. When the casing has an upper section which is upright in orientation, a lower section which is oriented at an inclination of greater than 45 degrees from vertical, and a transition section between the upper and lower sections, and preferably one flow control valve is provided within the transition section of the casing.

The one or more flow control valves preferably include one flow control valve adjacent the pump inlet of the pump. The apparatus may be used in combination with a plunger lift pump.

A gas separator may be connected in series between the tailpipe therebelow and the pump inlet thereabove, in which said at least one flow control valve is located below the gas separator.

The casing may have an upper section which is upright in orientation, a lower section which is oriented at an inclination of greater than 45 degrees from vertical, and a transition section between the upper and lower sections, in which the tailpipe is located within the transition section. Preferably, the tailpipe fluid inlet is located in proximity to a bottom of the transition section.

The tailpipe has an internal diameter which is less than that of said tubing string along a length of the tailpipe between the tailpipe fluid inlet and the tailpipe fluid outlet and wherein the tailpipe fluid inlet is reduced in diameter relative to the tailpipe fluid outlet.

The tailpipe may include a lower section adjacent to the tailpipe fluid inlet having a first internal diameter along a length thereof, and an upper section above the lower section which spans a majority of a length of the tailpipe having a second internal diameter along a length thereof which is greater than the first internal diameter.

The apparatus may further include an isolating member supported within an annulus between the casing and the tailpipe to block flow in the annulus across the isolating member, in which the isolating member is located adjacent to the tailpipe fluid inlet.

An auxiliary member may be supported within the annulus between the casing and the tailpipe to block flow in the annulus across the auxiliary member, in which the auxiliary member is located in proximity to the fluid outlet of the tailpipe.

The apparatus described above may further comprise: (i) the tailpipe having an internal diameter which is less than that of said tubing string along a length of the tailpipe between the tailpipe fluid inlet and the tailpipe fluid outlet; (ii) tailpipe fluid inlet being reduced in diameter relative to the tailpipe fluid outlet; and (iii) an isolating member supported within an annulus between the casing and the tailpipe to block flow in the annulus across the isolating member, the isolating member being located adjacent to the tailpipe fluid inlet.

According to a second aspect of the present invention there is provided an apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and coupled to the pump inlet to deliver well liquids thereto;

said tailpipe has an internal diameter less than that of said tubing string to thereby purposefully increase the gas velocity inside which generates a flowing condition possessing a higher gas void fraction (GVF) and thus reduces the pressure gradient of the well fluids flowing in said tailpipe as compared to a pressure gradient that would exist without use of said tailpipe, and thereby correspondingly reduce a minimum required producing bottom hole pressure as well as production rate to lift fluids and correspondingly increase well deliquification and fluid production in the oil and gas well; and said tailpipe fluid inlet being reduced in diameter relative to said tailpipe fluid outlet.

The tailpipe preferably includes a lower section adjacent to the tailpipe fluid inlet having a first internal diameter along a length thereof, and an upper section above the lower section which spans a majority of a length of the tailpipe having a second internal diameter along a length thereof which is greater than the first internal diameter.

The apparatus may further include an isolating member supported within an annulus between the casing and the tailpipe to block flow in the annulus across the isolating member, the isolating member being located adjacent to the tailpipe fluid inlet. In this instance, an auxiliary member may be supported within the annulus between the casing and the tailpipe to block flow in the annulus across the auxiliary member in which the auxiliary member is located in proximity to the fluid outlet of the tailpipe.

According to another aspect of the present invention there is provided an apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and coupled to the pump inlet to deliver well liquids thereto; and an isolating member supported within an annulus between the casing and the tailpipe to block flow in the annulus across the isolating member;

the isolating member being located adjacent to the tailpipe fluid inlet.

The apparatus may further include a second isolating member supported within the annulus between the casing and the tailpipe to block flow in the annulus thereacross, the second isolating member being located in proximity to the fluid outlet of the tailpipe.

According to a further aspect of the present invention there is provided a method of producing well fluids including well liquids and well gases, using the apparatus described above in an oil and gas well having a casing extending down to an oil and gas formation wherein the casing has an interior and has perforations formed therethrough for receiving oil and gas from the formation and the well having a pump supported from a tubing string with a pump inlet located above the perforations, the method comprising:

operating the pump, thereby enabling well liquids to flow into the pump inlet, and inducing flow of the well fluids below the pump, including:

enabling well fluids to flow from the oil and gas formation, through the perforations, and into the casing; and inducing the well fluids to flow up said tailpipe from the fluid inlet located proximate the oil and gas formation and the outlet located above said fluid inlet, the tailpipe having an internal diameter that is less than the tubing string diameter to thereby purposefully increase the gas velocity inside which generates a flowing condition possessing a higher gas void fraction (GVF) and thus reduces the pressure gradient of the well fluids therein, as compared to a pressure gradient that would exist without use of the tailpipe without two-isolation, as a result of the smaller diameter thereof, and thereby correspondingly reduce a minimum required producing bottom hole pressure as well as production rate to lift fluids and correspondingly increase well deliquification and fluid production from the oil and gas well.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
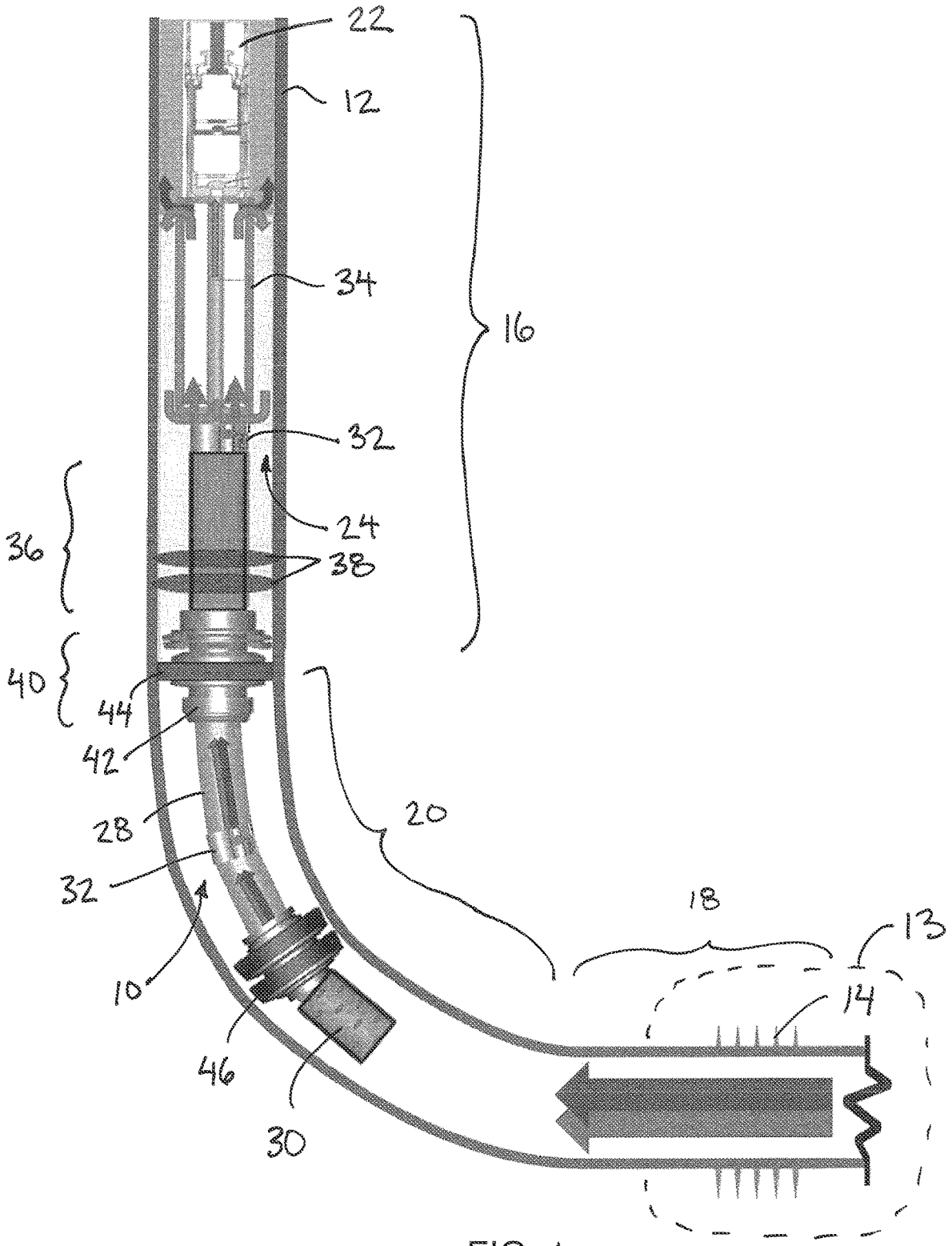
FIG. 1 is partly sectional schematic view of the apparatus within a wellbore casing according to a first embodiment of the invention.

Referring to the accompanying figures there is provided an apparatus generally indicated by reference numeral 10 for the production of well fluids including well liquids and well gases. Although various embodiments of the apparatus 10 are described and illustrated herein, the features in common with the various embodiments will first be described.

The apparatus 10 is suited for use in an oil and gas well of the type having a casing 12 extending downwardly from a wellhead at surface to an oil and gas formation 13 below ground. The casing 12 defines a tubular passage extending longitudinally within the interior thereof. Perforations 14 are provided within the casing to extend through the wall of the casing in alignment with the oil and gas formation 13 for receiving oil and gas from the formation.

The casing typically includes an upper section 16 which is generally upright in orientation so as to be substantially vertical or less than 45° inclination from vertical to extend downwardly from the wellhead into the ground. The casing further includes a lower section 18 which may be horizontal or inclined at a slope of greater than 45° from vertical to extend through the oil and gas formation. The casing can also include a transition section 20 located at an intermediate location connected between the upper section 16 thereabove and the lower section 18 therebelow. The transition section 20 may be a curved section in which the orientation of the casing transitions gradually from the upright orientation of the upper section to the lateral orientation of the lower section.

The well receives a tubing string 22 therein which extends longitudinally through the tubular passage within the interior of the casing. An outer diameter of the tubing string is undersized relative to the interior diameter of the casing to define a well annulus 24 between the tubing string and the surrounding casing. The tubing string defines a tubular passage extending longitudinally along the string within the interior of the tubing string for communicating produced fluids therethrough from the formation up to the wellhead.

A pump 26 is connected in series with the tubing string. The pump may be of various types, typically mounted at the bottom end of the tubing string 22 such as a plunger lift type pump or a submersible pump which is a hydraulically or electrically driven for example. The pump is typically cycled or reciprocated for lifting fluid in stages from the inlet at the bottom of the pump to an outlet of the pump connected to the tubing string thereabove.

A tailpipe 28 is provided as a section of tubing connected in series below the pump 26. The tailpipe communicates between an inlet opening 30 at the bottom end thereof and an outlet at the top end thereof which communicates with the pump inlet. The tailpipe has an internal diameter that is less than the tubing string diameter to thereby reduce a pressure gradient of the well fluids therein, as compared to a pressure gradient that would exist without use of the tailpipe, as a result of the smaller diameter thereof, and thereby correspondingly reduce a minimum required producing bottom hole pressure and correspondingly increase well fluid production from the oil and gas well.

The tailpipe is typically located such that the inlet at the bottom end thereof is in close proximity to or spaced slightly above the perforations in communication with the oil and gas formation. More particularly the tailpipe section is preferably located so as to be mostly or entirely within the transition section 20 of the casing with the inlet at the bottom end being in proximity to the bottom of the transition section 20.

The tailpipe 28 may include a lower section that is adjacent to the tailpipe fluid inlet and that has a first internal diameter which is constant along the length thereof. An upper section of the tailpipe continues above the lower section up to the outlet at the top end of the tailpipe in which the upper section spans a majority of the overall length of the tailpipe. The upper section has a second internal diameter which is constant along the length of thereof which is greater than the first internal diameter of the lower section such that the overall tailpipe 28 is tapered and reduced in cross-sectional flow area at the inlet end thereof relative to the remainder of the tailpipe.

In further embodiments, the tailpipe may comprise three or more sections in which each section is reduced in internal diameter relative to the section therebelow to more gradually taper the cross sectional flow area of the tailpipe from the top to the bottom thereof.

The apparatus further includes one or more flow control valves 32 connected in series with the tailpipe. In the preferred embodiments, a first one of the flow control valves is located at an intermediate location along the tailpipe 28 so as to be within the upper section of the tailpipe at a location spaced above the inlet and the lower section of the tailpipe. A second flow control valve 32 is typically located in series between the tailpipe 28 therebelow and the pump 26 thereabove at a location above the top end of the tailpipe.

Each flow control valve 32 is a hydrostatic pressure regulated valve, for example an auto dump valve, which functions to retain fluid in the tubing thereabove below a hydrostatic rating or pressure limit value associated with the valve while permitting excess fluid above the rating or pressure limit value to be released back into the tubing below the valve. The hydrostatic rating or pressure limit value of the valve is adjustable or settable value which is designated by the operator according to the conditions of the well.

The flow control valve 32 operates somewhat like a check valve in that the valve will open when the fluid pressure below the flow control valve exceeds the fluid pressure above the flow control valve to allow upward flow through the valve. Typically, the valve will automatically close when the fluid pressure above the valve exceeds the fluid pressure below the valve but on the condition that the amount that the upper fluid pressure exceeds the lower fluid pressure does not exceed the pressure limit value so as to hold fluid within the apparatus above the flow control valve. When the upper fluid pressure exceeds the lower fluid pressure by an amount which exceeds the pressure limit value, the flow control valve functions to release the excess fluid back down the tailpipe until the pressure differential falls back below the pressure limit value.

In this instance, as the pump is cycled in operation, fluid is lifted above the flow control valve with each positive cycle of the pump with at least part of the upwardly pumped fluid being retained above the valve on the subsequent negative portion of the pumping cycle. In this instance, less work is required to pump the fluid upwardly on the next positive portion of the pumping cycle due to a portion of the fluid already being retained above each flow control valve.

Turning now more particularly to the embodiment of FIG. 1, in this instance the pump comprises a driven pump, for example a submersible pump which is hydraulically or electrically driven, or a reciprocating pump driven by a rod string. The apparatus in this instance further includes a gas separator 34 connected in series below the pump such that an outlet of the gas separator communicates produced fluids into the inlet of the pump thereabove. More particularly the gas separator has a fluid inlet for receiving well fluids into an upper region of the separator for discharge into a separation annulus zone defined between an exterior of the separator and the interior wall of the casing adjacent to the separator and a liquid inlet at a lower region of the separator for receiving liquid from said separation annular zone for transfer upward to an inlet of the pump thereabove.

A solid collector 36 is supported below the gas separator 34 including a tubular section having an interior passage connected in series with the gas separator thereabove and the tailpipe therebelow. A plurality of baffles 38 surround the tubular section of the solid collector to span the annulus between the tubular section and the surrounding casing such that the baffles serve to collect any solids accumulating in the annulus as flow is directed through a portion of the annulus by the gas separator thereabove.

The apparatus further includes an upper isolating member 40 comprising an inner pipe 42 connected in series with the pump inlet thereabove and the outlet of the tailpipe therebelow. More particularly the inner pipe 42 is connected in series directly below the tubular section of the solid collector 36 which is in turn located directly below the gas separator 34. The upper isolating member 40 comprises an annular member 44 surrounding the inner pipe 42 and fully spanning the annular space between the inner pipe 42 and the surrounding casing so as to block flow in the annulus across the isolating member and isolate pressure between the annulus above and the annulus below.

The tailpipe 28 in this instance is connected directly below the inner pipe 42 of the upper isolating member 40. The apparatus may further include a lower isolating member 46 which is mounted at an intermediate location along the tailpipe 28 such that flow through the tailpipe is uninhibited, however, the lower isolating member 46, like the upper isolating member 44 comprises an annular member fully spanning across the annulus passage that fully occupies the space between the outer diameter of the tailpipe and the inner diameter of the surrounding casing to block flow and isolate pressure in the annulus similarly to the upper isolating member 40. The lower isolating member 46 is mounted about the tailpipe adjacent to the inlet at the bottom end thereof.

In the embodiment of FIG. 1, one of the flow control valves 32 is located at an intermediate location along the tailpipe spaced above the lower isolating member 46 and below the upper isolating member 40, while a second flow control valve 32 is located in series between the solid collector 36 therebelow and the gas separator 34 thereabove.

Figure 2:
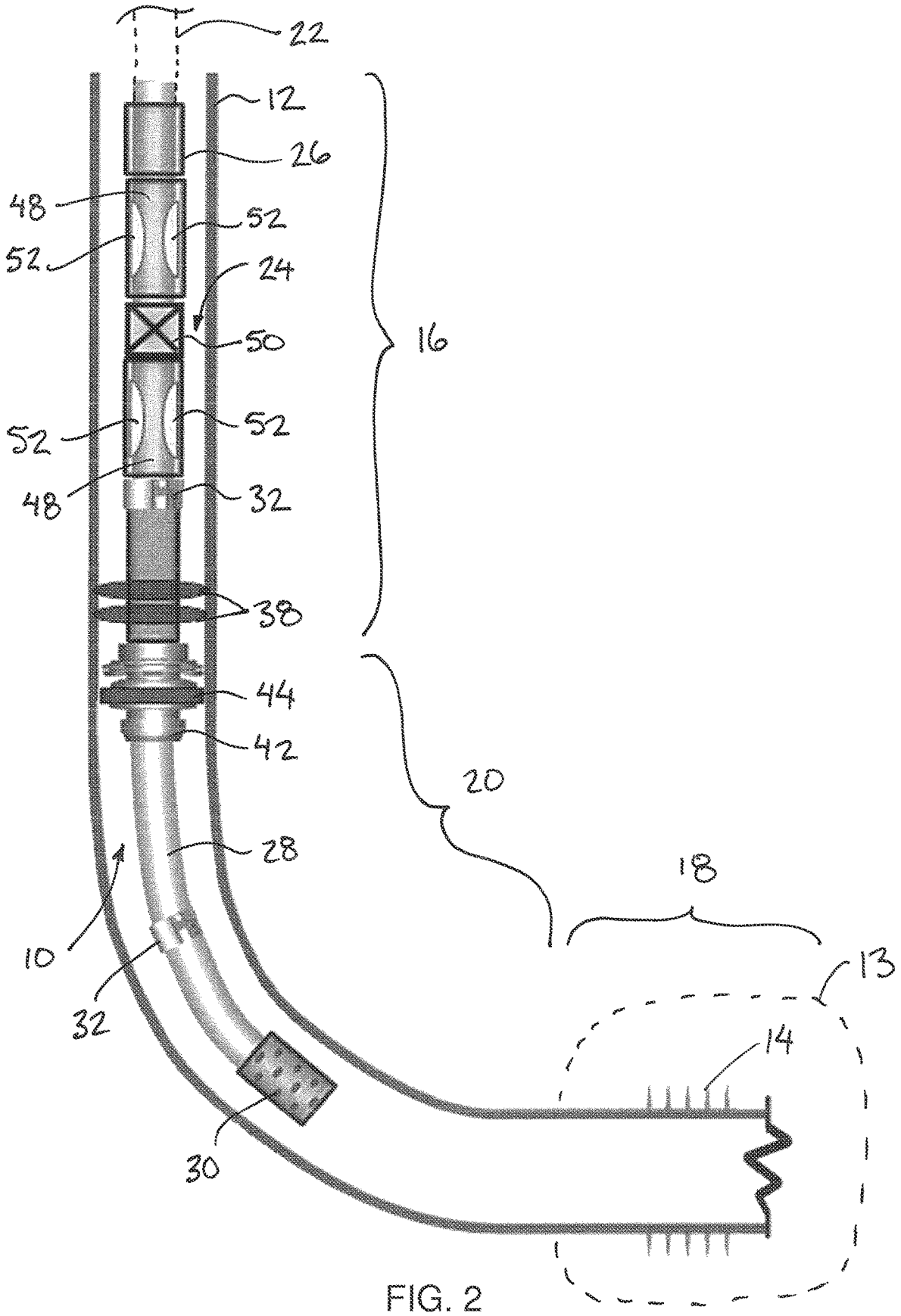
FIG. 2 is partly sectional schematic view of the apparatus within a wellbore casing according to a second embodiment of the invention.

Turning now to a second embodiment shown in FIG. 2, in this instance the pump 26 comprises a plunger lift type pump using a rod to reciprocate the plunger of the pump connected to a driver thereabove or relying on wellbore pressure being cyclically released to drive the pump. In this instance, the apparatus is similar to the configuration of the first embodiment of FIG. 1 with the exception of the absence of the lower isolating member 46 and the replacement of the separator 34 with an assembly comprising two diverter pipe sections 48 with a plug 50 connected therebetween. More particularly, the diverter pipe sections include an upper diverter pipe section having an outlet at the top end connected in series to the inlet of the pump thereabove. A plurality of fluid ports 52 communicate through the wall of the pipe section 48 so that fluid from the surrounding annulus may enter through the ports into the hollow interior of the upper diverter pipe section which then communicates through the outlet at the top end thereof to the pump. The plug 50 blocks direct communication with the hollow interior of the upper diverter pipe section 48 through the bottom end thereof. A lower diverter pipe section 48 is connected directly below the plug 50 with similar ports 52 formed in the outer wall thereof such that fluid entering the hollow interior of the lower diverter pipe section through the open bottom end thereof into the hollow interior of the diverter pipe section can then be diverted through the ports into the surrounding annulus by the plug 50 which blocks the top end of the lower diverter pipe section. The upper flow control valve 32 in this instance is connected between the solid collector 36 in series therebelow and the open bottom end of the lower diverter pipe section 48 thereabove. The solid collector 36 is similar in configuration to the previous embodiment for collecting solids accumulating in the annulus as a result of the flow being diverted upwardly and outwardly through the annulus from the lower diverter pipe section to the upper diverter pipe section.

The upper isolating member 40 and the tailpipe 28 remain configured as in the previous embodiment with the exception of the lower isolating member 46 being absent.

Figure 3:
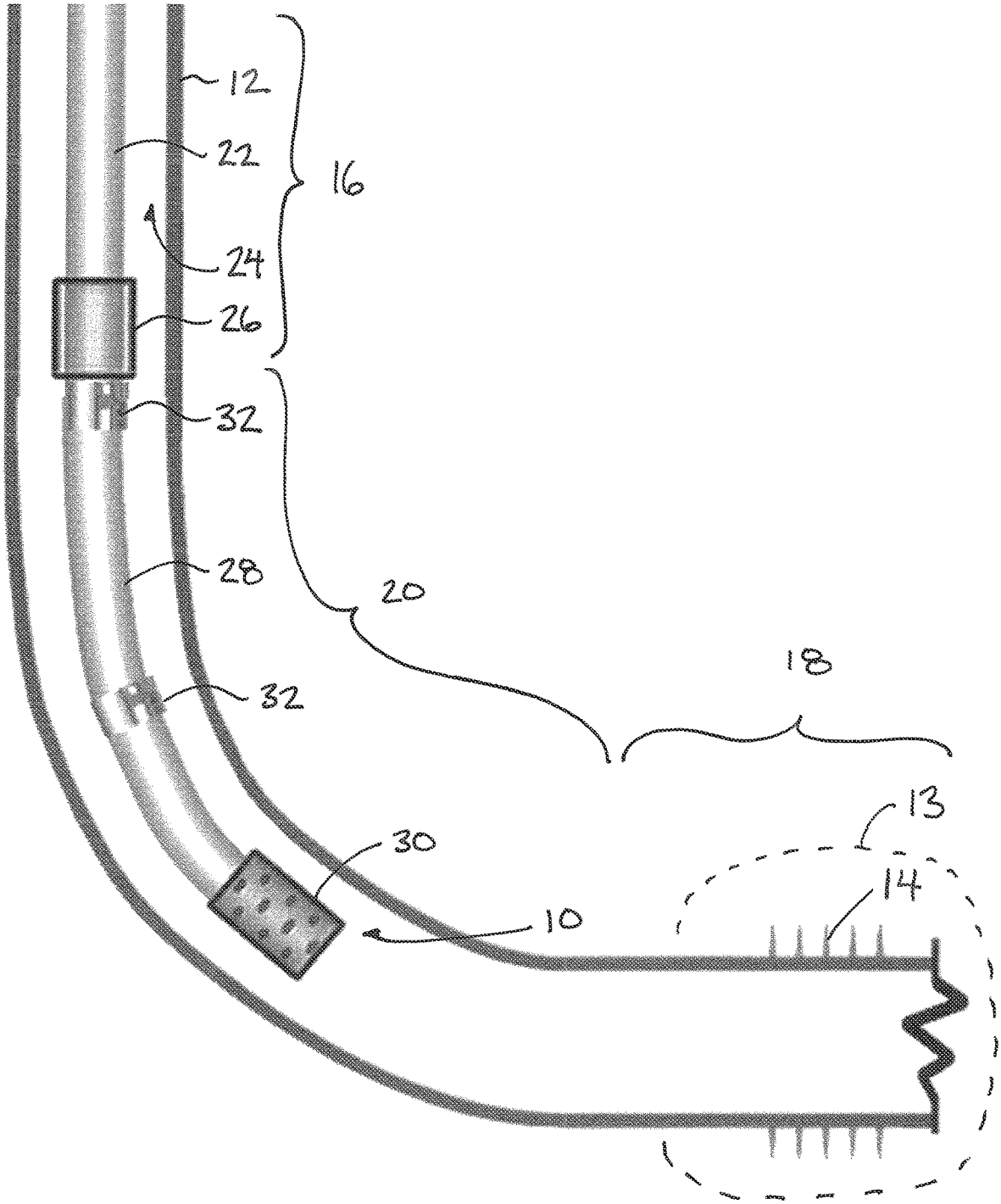
FIG. 3 is partly sectional schematic view of the apparatus within a wellbore casing according to a third embodiment of the invention.

Turning now to a further embodiment shown in FIG. 3, in this instance the tailpipe 28 is provided directly below the pump 26 such that the outlet at the top of the tailpipe is coupled to the pump inlet at the bottom end thereof. The pump may comprise a plunger type lift pump as in the previous embodiment. The flow control valves 32 are again provided as a first valve at an intermediate location within the tailpipe and as a second valve at the top end of the tailpipe in communication with the pump inlet thereabove.

In further embodiments, the configuration of the tailpipe 28 having a lower section which is tapered relative to an upper section thereof may be used independently of the flow control valves 32 or the isolating members 40 and/or 46. Similarly the flow control valves 32 may be used independently of the configuration of the tailpipe or the other components described herein. The lower isolating member at the bottom end of the tailpipe may also have benefits independently of the configuration of the tailpipe or the incorporation of the flow control valve therein. Any combination of these features may have some benefits in assisting in the lifting of well liquids and well gasses in a well having a lower section which is inclined or substantially horizontal.

In all embodiments, a similar method of producing well fluids including well liquids and well gases can be accomplished using one of the embodiments described above. In each instance the pump is operated to enable well liquids to flow into the pump inlet which induces flow of the well fluids below the pump including enabling well fluids to flow from the oil and gas formation through the perforations and into the casing and inducing the well fluid to flow up the tailpipe from the tailpipe fluid inlet in proximity to the oil and gas formation to the tailpipe fluid outlet located above the fluid inlet.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto; and at least one pressure-regulated flow control valve connected in series with the tailpipe, the at least one pressure-regulated flow control valve being operable between open and closed states and having a pressure limit value associated therewith;

the at least one pressure-regulated flow control valve being configured to open and allow upward flow through the pressure-regulated flow control valve in response to a lower fluid pressure below the pressure-regulated flow control valve exceeding an upper fluid pressure above the pressure-regulated flow control valve to;

the at least one pressure-regulated flow control valve being configure to close and hold fluid in the apparatus above the pressure-regulated flow control valve in response to the upper fluid pressure exceeding the lower fluid pressure by an amount which does not exceed the pressure limit value; and the at least one pressure-regulated flow control valve being configured to open and release excess fluid back down the tailpipe in response to the upper fluid pressure exceeding the lower fluid pressure by an amount which exceeds the pressure limit value.

2. The apparatus according to claim 1 wherein said at least one pressure-regulated flow control valve comprises two flow control valves at longitudinally spaced locations relative to one another.

3. The apparatus according to claim 1 wherein said at least one pressure-regulated flow control valve includes one flow control valve at a location spaced above a bottom end of the tailpipe.

4. The apparatus according to claim 1 wherein the casing has an upper section which is upright in orientation, a lower section which is oriented at an inclination of greater than 45 degrees from vertical, and a transition section between the upper and lower sections, and wherein said at least one pressure-regulated flow control valve includes one flow control valve within the transition section of the casing.

5. The apparatus according to claim 1 wherein said at least one pressure-regulated flow control valve includes one flow control valve adjacent the pump inlet of the pump.

6. The apparatus according to claim 5 in combination with the pump wherein the pump comprises a plunger lift pump.

7. The apparatus according to claim 1 further comprising a gas separator connected in series between the tailpipe therebelow and the pump inlet thereabove, wherein said at least one pressure-regulated flow control valve is located below the gas separator.

8. The apparatus according to claim 1 wherein the casing has an upper section which is upright in orientation, a lower section which is oriented at an inclination of greater than 45 degrees from vertical, and a transition section between the upper and lower sections, and wherein the tailpipe is located within the transition section.

9. The apparatus according to claim 8 wherein the tailpipe fluid inlet is located in proximity to a bottom of the transition section.

10. The apparatus according to claim 1 wherein the tailpipe has an internal diameter which is less than that of said tubing string along a length of the tailpipe between the tailpipe fluid inlet and the tailpipe fluid outlet and wherein the tailpipe fluid inlet is reduced in diameter relative to the tailpipe fluid outlet.

11. The apparatus according to claim 10 wherein the tailpipe includes a lower section adjacent to the tailpipe fluid inlet having a first internal diameter along a length thereof, and an upper section above the lower section which spans a majority of a length of the tailpipe having a second internal diameter along a length thereof which is greater than the first internal diameter.

12. The apparatus according to claim 1 further comprising an isolating member supported within an annulus between the casing and the tailpipe to block flow in the annulus across the isolating member, the isolating member being located adjacent to the tailpipe fluid inlet.

13. The apparatus according to claim 12 further comprising an auxiliary member supported within the annulus between the casing and the tailpipe to block flow in the annulus across the auxiliary member, the auxiliary member being located in proximity to the fluid outlet of the tailpipe.

14. The apparatus according to claim 1 further comprising:

the tailpipe having an internal diameter which is less than that of said tubing string along a length of the tailpipe between the tailpipe fluid inlet and the tailpipe fluid outlet;

tailpipe fluid inlet being reduced in diameter relative to the tailpipe fluid outlet; and an isolating member supported within an annulus between the casing and the tailpipe to block flow in the annulus across the isolating member, the isolating member being located adjacent to the tailpipe fluid inlet.

15. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto;

said tailpipe being located within the casing so as to define an annulus passage fully occupying a space between an outer diameter of the tailpipe and an inner diameter of the casing;

said tailpipe has an internal diameter less than that of said tubing string to thereby purposefully increase the gas velocity inside which generates a flowing condition possessing a higher gas void fraction (GVF) and thus reduces the pressure gradient of the well fluids flowing in said tailpipe as compared to a pressure gradient that would exist without use of said tailpipe, and thereby correspondingly reduce a minimum required producing bottom hole pressure as well as production rate to lift fluids and correspondingly increase well deliquification and fluid production in the oil and gas well; and said tailpipe fluid inlet being reduced in diameter relative to said tailpipe fluid outlet.

16. The apparatus according to claim 15 wherein the tailpipe includes a lower section adjacent to the tailpipe fluid inlet having a first internal diameter along a length thereof, and an upper section above the lower section which spans a majority of a length of the tailpipe having a second internal diameter along a length thereof which is greater than the first internal diameter.

17. The apparatus according to claim 15 further comprising an isolating member supported within the annulus passage between the casing and the tailpipe to block flow in the annulus passage across the isolating member, the isolating member being located adjacent to the tailpipe fluid inlet.

18. The apparatus according to claim 17 further comprising an auxiliary member supported within the annulus passage between the casing and the tailpipe to block flow in the annulus passage across the auxiliary member, the auxiliary member being located in proximity to the fluid outlet of the tailpipe.

19. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto;

said tailpipe being located within the casing so as to define an annulus passage fully occupying a space between an outer diameter of the tailpipe and an inner diameter of the casing; and an isolating member supported within the annulus passage, to fully span across the annulus passage between the inner diameter of the casing and the outer diameter of the tailpipe to block flow in the annulus passage across the isolating member;

the isolating member being located adjacent to the tailpipe fluid inlet.

20. The apparatus according to claim 19 further comprising an auxiliary member supported within the annulus passage between the casing and the tailpipe to block flow in the annulus passage across the auxiliary member, the auxiliary member being located in proximity to the fluid outlet of the tailpipe.

21. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto; and at least one flow control valve connected in series with the tailpipe being operable between open and closed states and having a pressure limit value associated therewith, the at least one flow control valve being operable to (i) open when a lower fluid pressure below the flow control valve exceeds an upper fluid pressure above the flow control valve to allow upward flow through the flow control valve (ii), close when the upper fluid pressure exceeds the lower fluid pressure by an amount which does not exceed the pressure limit value to hold fluid in the apparatus above the flow control valve, and (iii) open when the upper fluid pressure exceeds the lower fluid pressure by an amount which exceeds the pressure limit value to release excess fluid back down the tailpipe;

wherein the casing has an upper section which is upright in orientation, a lower section which is oriented at an inclination of greater than 45 degrees from vertical, and a transition section between the upper and lower sections, and wherein said at least one flow control valve includes one flow control valve within the transition section of the casing.

22. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto; and at least one flow control valve connected in series with the tailpipe being operable between open and closed states and having a pressure limit value associated therewith, the at least one flow control valve being operable to (i) open when a lower fluid pressure below the flow control valve exceeds an upper fluid pressure above the flow control valve to allow upward flow through the flow control valve (ii), close when the upper fluid pressure exceeds the lower fluid pressure by an amount which does not exceed the pressure limit value to hold fluid in the apparatus above the flow control valve, and (iii) open when the upper fluid pressure exceeds the lower fluid pressure by an amount which exceeds the pressure limit value to release excess fluid back down the tailpipe;

wherein the casing has an upper section which is upright in orientation, a lower section which is oriented at an inclination of greater than 45 degrees from vertical, and a transition section between the upper and lower sections, and wherein the tailpipe is located within the transition section.

23. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto; and at least one flow control valve connected in series with the tailpipe being operable between open and closed states and having a pressure limit value associated therewith, the at least one flow control valve being operable to (i) open when a lower fluid pressure below the flow control valve exceeds an upper fluid pressure above the flow control valve to allow upward flow through the flow control valve (ii), close when the upper fluid pressure exceeds the lower fluid pressure by an amount which does not exceed the pressure limit value to hold fluid in the apparatus above the flow control valve, and (iii) open when the upper fluid pressure exceeds the lower fluid pressure by an amount which exceeds the pressure limit value to release excess fluid back down the tailpipe;

wherein the tailpipe has an internal diameter which is less than that of said tubing string along a length of the tailpipe between the tailpipe fluid inlet and the tailpipe fluid outlet and wherein the tailpipe fluid inlet is reduced in diameter relative to the tailpipe fluid outlet.

24. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto;

at least one flow control valve connected in series with the tailpipe being operable between open and closed states and having a pressure limit value associated therewith, the at least one flow control valve being operable to (i) open when a lower fluid pressure below the flow control valve exceeds an upper fluid pressure above the flow control valve to allow upward flow through the flow control valve (ii), close when the upper fluid pressure exceeds the lower fluid pressure by an amount which does not exceed the pressure limit value to hold fluid in the apparatus above the flow control valve, and (iii) open when the upper fluid pressure exceeds the lower fluid pressure by an amount which exceeds the pressure limit value to release excess fluid back down the tailpipe;

an lower isolating member supported within an annulus between the casing and the tailpipe to block flow in the annulus across the lower isolating member, the lower isolating member being located adjacent to the fluid inlet of the tailpipe; and an upper isolating member supported within the annulus between the casing and the tailpipe to block flow in the annulus across the upper auxiliary member, the upper isolating member being located in proximity to the fluid outlet of the tailpipe.

25. An apparatus for production of well fluids, including well liquids and well gases, in an oil and gas well having a casing extending down to an oil and gas formation wherein the casing has an interior and has perforations formed therethrough for receiving oil and gas from the formation and the well having a pump supported from a tubing string with a pump inlet located above the perforations, the apparatus comprising:

a tailpipe having a fluid inlet for receiving the formation well fluids that enter the casing through the perforations, and having a fluid outlet located above said tailpipe fluid inlet and communicating with the pump inlet to deliver well liquids thereto;

said tailpipe has an internal diameter less than that of said tubing string to thereby purposefully increase the gas velocity inside which generates a flowing condition possessing a higher gas void fraction (GVF) and thus reduces the pressure gradient of the well fluids flowing in said tailpipe as compared to a pressure gradient that would exist without use of said tailpipe, and thereby correspondingly reduce a minimum required producing bottom hole pressure as well as production rate to lift fluids and correspondingly increase well deliquification and fluid production in the oil and gas well;

said tailpipe fluid inlet being reduced in diameter relative to said tailpipe fluid outlet; and said tailpipe including a lower section adjacent to the tailpipe fluid inlet having a first internal diameter along a length thereof and an upper section above the lower section which spans a majority of a length of the tailpipe having a second internal diameter along a length thereof which is greater than the first internal diameter.

* * * * *